US005190462A

United States Patent [19]

Lauchner et al.

[11] Patent Number: 5,190,462

[45] Date of Patent: Mar. 2, 1993

[54] MULTILEAD MICROWAVE CONNECTOR

[75] Inventors: John K. Lauchner; Andrew J. Schlaiss, both of Tempe; Robert S. Ames, Scottsdale, all of Ariz.

[73] Assignee: Motorola, Inc., Schaumburg, Ill.

[21] Appl. No.: 754,484

[22] Filed: Sep. 3, 1991

[51] Int. Cl.[5] ..... H01R 9/09

[52] U.S. Cl. ..... 439/65; 361/416; 439/284

[58] Field of Search ..... 439/61, 65, 74, 290, 439/291, 284; 361/412, 413, 415, 416

[56] References Cited

U.S. PATENT DOCUMENTS

| | | | |
|---|---|---|---|
| 2,701,346 | 2/1955 | Powell | 439/65 |
| 2,857,577 | 10/1958 | Vanderpool | 439/59 |
| 2,951,184 | 8/1960 | Wyma | 361/412 |
| 3,175,127 | 3/1965 | Knox-Seith | 439/74 |

*Primary Examiner*—Neil Abrams

*Attorney, Agent, or Firm*—Robert M. Handy

[57] ABSTRACT

An N×M electrical connector suitable for use at microwave frequencies comprises a first set of N insulating parallel substrates each containing M notches with adjacent planar conductors and a second set of M parallel substrates having up to N spaced-apart conductors, wherein the notch-to-notch and conductor-to-conductor spacing of the first set matches the substrate-to-substrate spacing of the second set and vice versa, so that when the second set is pushed into the notches of the first set, each notch and associated conductor on the second set of "L" shaped relation. One or more spring contacts at each intersection provide positive electrical connection between the proximate conductors. The arrangement is especially useful for microwave systems since multiple signal lines and ground planes may be connected simultaneously without interference or substantial electrical discontinuity.

9 Claims, 5 Drawing Sheets

MULTILEAD MICROWAVE CONNECTOR

FIELD OF THE INVENTION

The present invention concerns an improved means and method for a multilead connector suitable for use at microwave frequencies.

BACKGROUND OF THE INVENTION

Electrical and electronic systems make use of connectors for coupling different portions of the system together. Such connectors must generally be capable of being engaged and disengaged so that the different parts of the system may be separated, as for example during construction and testing or for transportation and repair.

Many different types of connectors are used in the prior art. Generally the design and construction of such connectors becomes more complex as they are called upon to handle electrical energy at higher and higher frequencies. When microwave frequencies are involved, as for example, above a few hundred megaHertz and more typically above about 0.5 to 1 gigaHertz, it is generally desired to maintain uniform impedance in the signal path. This is because impedance discontinuities cause insertion loss and reflections that adversely affect the system performance. It is especially difficult to avoid such adverse affects in multilead microwave connectors.

Coaxial cables and connectors are common with single lead conductors. However, as the number of leads increase, coaxial connectors are more and more difficult to use. Further, an additional connector or joint must be provided between the coaxial cable and the flat circuit board on which microwave circuits or systems are typically fabricated. This can introduce further losses and reflections in the microwave path.

Thus, there continues to be a need for improved multilead electrical connectors, especially connectors suitable for use a microwave frequencies, and further for improved connectors which can accommodate a large number of leads.

As used herein the words "conductor" and "conductors" refer to leads capable of carrying electrical signals, and "microwave conductor" and "microwave conductors" refer to conductors capable of carrying signals at high frequencies, as for example, above about 0.5 gigaHertz. Microwave conductors include but are not limited to stripline and microstripline conductors.

SUMMARY OF THE INVENTION

The present invention provides an improved means and method for electrical connectors, especially electrical connectors having multiple leads and suitable for use at microwave frequencies. The present invention is especially convenient in connection with circuit boards and the like employing microwave conductors.

There is provided an electrical connector comprising at least first and second partially intersecting and generally planar insulating substrates (e.g., PC boards) having thereon a plurality of (e.g., planar) conductors which are coupled where the substrates intersect. The substrates conveniently intersect at about right angles although other angles can also be used.

In the intersect region, there are four quadrants in which leads on one substrate may be electrically coupled to leads on the other substrate. For example, signal leads are coupled in the quadrant where front sides of the substrates intersect (e.g., quadrant one) and, at the same time, opposed ground planes may be coupled in the quadrant where the back sides intersect (e.g., quadrant three). In the remaining quadrants, both signal and ground leads may be coupled, but this is not essential. This arrangement is especially well suited for substrates employing microwave conductors. Large electrical discontinuities are avoided and insertion loss and reflections are minimized.

In a preferred embodiment, the first substrate has one or more notches or slots extending inwardly from one edge of the substrate and of a width to accommodate the thickness of the second substrate. A first planar conductor on the front side of the substrate is located proximate to the notch. An optional opposed ground plane may be present on the back side of the substrate for shielding and impedance control. Such ground planes are common at microwave frequencies.

The second substrate has a mating planar conductor located so as to be adjacent to the first planar conductor when the second substrate is slipped into the notch in the first substrate. The two conductors form an approximate L shape with the conductor on one substrate being the base leg and the conductor on the other substrate being the upright leg.

Preferably, a spring finger or other resilient contact is used to provide a sliding pressure contact between the adjacent L-oriented conductors, however other coupling means may also be used. A similar arrangement couples ground planes on the two substrates.

It is desirable that the second substrate also be notched but this is not essential. Having both substrates notched facilitates precise alignment of the intersection region so that, when the substrates are engaged, the conductors being coupled are in close proximity.

An $N \times M$ connector is obtained by combining a first assembly of N first substrates containing M notches and associated conductors with a second assembly of M second substrates having up to N mating conductors, wherein the notch-to-notch and associated conductor-to-conductor spacing of the first set of substrates matches the substrate-to-substrate spacing of the second set of substrates, and vice versa, so that when the first and second sets of substrates are interlocked (e.g.,at right angles), each notch and associated conductor on the first set align in L-oriented relationship next to the mating conductors on the second set. The arrangement is especially useful for systems operating at microwave frequencies, but may be used at other frequencies as well.

An advantage of the invented arrangement is that substrates used to provide the demountable connector may also carry various active and/or passive electronic components so that connector and circuit board are integral. In this way, no cabling is needed to couple the electrical signals from the circuit board to the connector. This provides an extremely compact and low cost arrangement which eliminates various electrical joints necessary with prior art connectors.

DETAILED DESCRIPTION OF THE DRAWINGS

Figure 1:
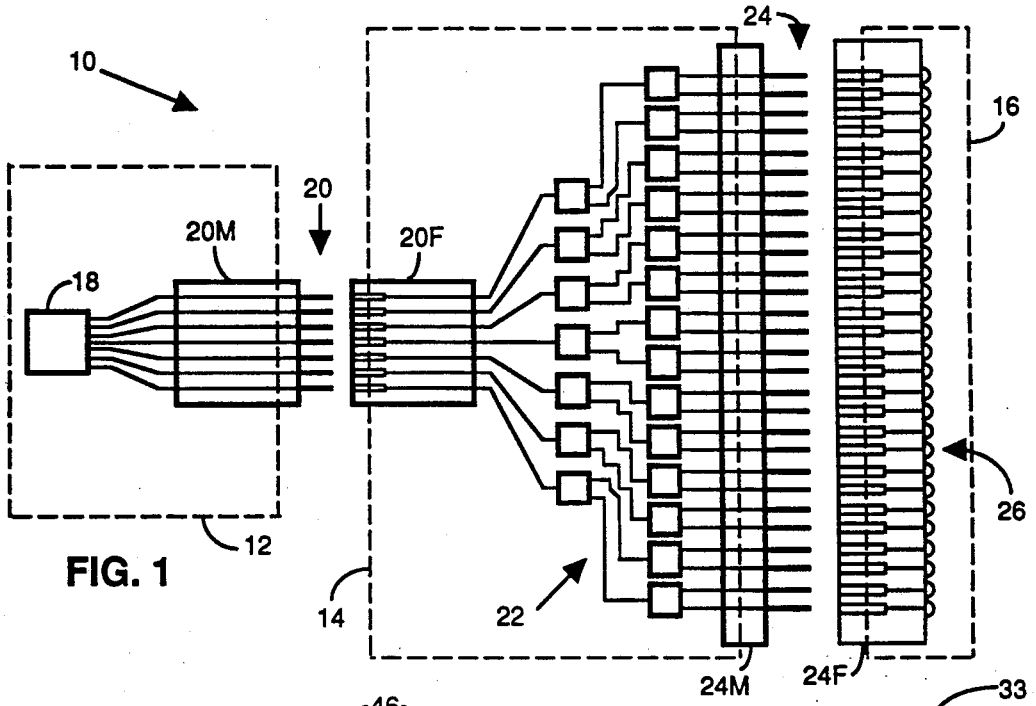
FIG. 1 illustrates in schematic form, an electrical system having multilead connectors therein.

Referring now to FIG. 1, electrical system 10 has three exemplary portions 12, 14, 16 able to be coupled or decoupled using connectors 20, 24. Signal source 18 provides electrical signals to connector 20 having mating plug portions 20M, 20F which join to provide electrical continuity between system portions 12, 14.

System portion 14 contains, for example, multiple switches or logic gates 22 which steer signals arriving from plug portion 20F to the multiple leads of plug portion 24M of demountable connector 24. Mating plug portion 24F couples these signals to circuit portion 16, as for example, an array 26 of radiating elements, each driven by a signal line passing through connector 24.

In the context of a microwave or an optical system, portion 16 might be an array of individual radiator and/or receptor elements 26 forming an electrically steerable radar or optical beam or forming multiple channels of a multiplexed communication system, portion 14 an assembly of power dividers and/or beam steering switches or multiplexers 22 driving the individual radiator/receiver elements, and portion 12 the power source and initial power dividers and/or beam steering or multiplexer logic.

As those of skill in the art will appreciate, system 10 is not intended to represent any particular electrical system, but merely to illustrate the connection problems encountered as the number of signal lines which must be accommodated increases. Connectors 20 and 24 are merely intended to show that connectors with a large numbers of individual leads may be required. The exact number of connector leads shown in FIG. 1 is not significant.

As those of skill in the art will understand based on these example, many different types of electrical systems have requirements for multilead connectors. Multi-pin plug and socket connectors are commonly used at low and intermediate frequencies. At higher frequencies, especially microwave frequencies, multiple lead coaxial connectors are also known, but because of the space required for connecting both the central lead and surrounding shield of each coaxial lead, they are limited in lead count and generally extremely bulky and expensive.

The problems associated with many of these prior art connectors are overcome by the present invention which is illustrated in connection with FIGS. 2–9 and the following description.

FIGS. 2A–B and 3A–B show front views (FIGS. 2A, 3A) and side views (FIGS. 2B, 3B) of mating portions 30, 50 of a multilead connector, according to a preferred embodiment of the present invention. For purposes of explanation, portions 30, 50 show, respectively, integral power dividers or steering logic or decoding switches 22 on portion 30 and integral radiator/receptors 26 on portion 50, but these are merely for convenience of explanation and not intended to be limiting. Connector portions 30, 50 may contain any desired electronic function or may contain merely a multiplicity of electrical leads with or without active and/or passive elements thereon. An important feature of the present invention is that such signal handling or processing elements may be constructed integrally with the connector elements, but this is not essential.

Connector portion 30 has front face "F" and rear or back side "B" on which are located one or more conductors. Connector portion 30 is conveniently in the form of a printed circuit (PC) board of a particular shape and design. Board 30 comprises insulating substrate 32 of thickness 33 on which are placed various conductors, with or without optional components. Substrate 32 is conveniently a printed circuit board material although any insulating substrate will serve. Substantially planar substrate materials are preferred. For operation at microwave frequencies, low loss materials are desirable. Suitable filled plastic resin or ceramic PC board materials are well known in the art. Substrate 32 has conductors on one or both principal faces, e.g., on face "F" or face "B".

Figure 2A:
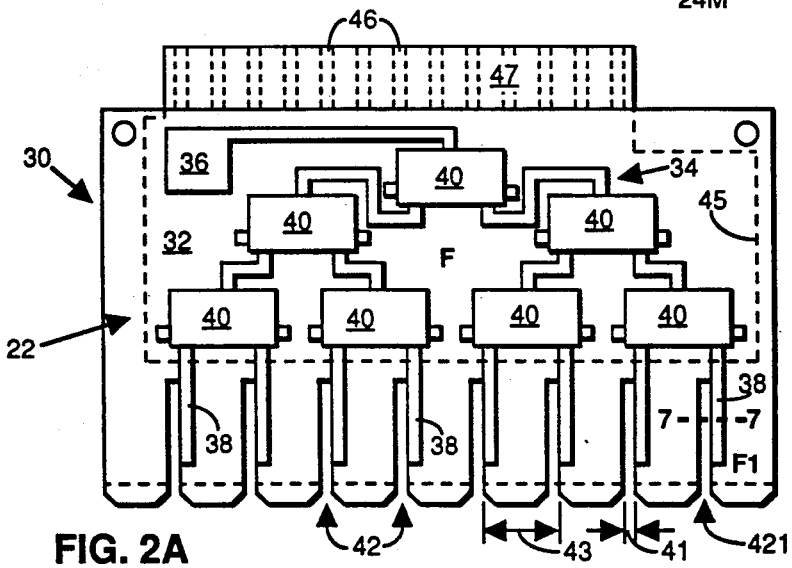
FIG. 2A shows a front view and FIG. 2B shows a right side view of an exemplary element of an electrical connector according to a first embodiment of the present invention.
Figure 2B:
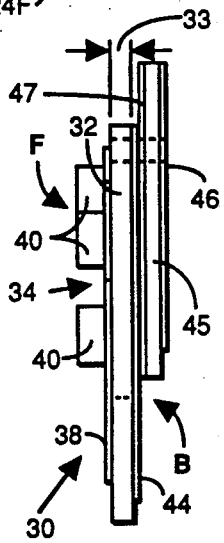
Figure 3A:
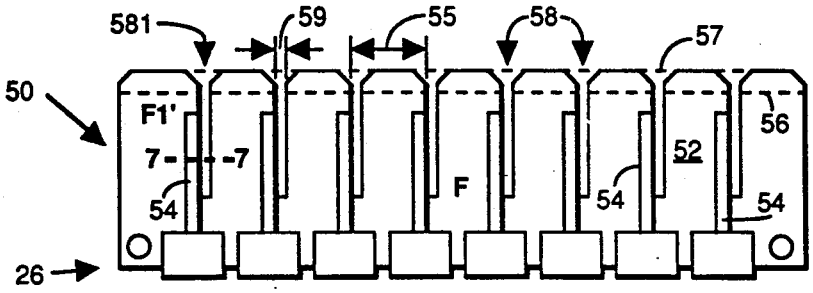
FIG. 3A shows a front view and FIG. 3B shows a right side view of another exemplary element of an electrical connector which mates with the element shown in FIGS. 2A–B, according to a first embodiment of the present invention.
Figure 3B:
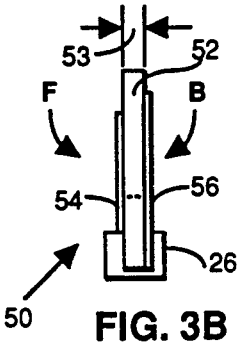

Conductors 34 on front face F extend from one or more input connections 36 to multiple output connections 38. Intermediate active or passive elements 40 may be provided between input 36 and output 38. FIGS. 2A–B show merely for purposes of illustration, an arrangement whereby components 40 are power dividers or switches splitting the signal from (or to) conductor 36 to conductors 38, e.g., one or more signals in at 36 and one or more signals out at 38, or one or more signals in at 38 and one or more signals out at 36. However, other arrangements and numbers of input and/or output leads may also be used.

Substrate 32 has multiple notches 42 of widths 41 separated by distances 43. One of the desired output leads 38 lies proximate to each notch 42. While efficient signal propagation takes place at low or moderate frequencies without a ground plane, where the connector is desired to handle microwave frequencies, ground plane conductor 44 is generally provided on opposed or back side "B" of substrate 32 (see FIG. 2B). Ground plane 44 conveniently covers most of back side B except where contact to elements 40 or other components is to be made through substrate 32

FIGS. 2A–B also illustrate the use of additional PC board 45 attached to back side B of substrate 32 to provide DC power or low frequency control signals to devices 40 through leads 46. PC board 45 may also have ground plane 47. PC board 45 is optional and depends on whether active elements are present on substrate 32 and whether there is sufficient space to accommodate their power and control leads as well as the (e.g., RF) signal leads on substrate 32 or whether an auxiliary substrate, e.g., PC board 45, is required. As will be understood by persons of skill in the art, this depends upon the particular system desired to be implemented.

Means and methods for fabricating substrate 32 with conductors 34, 38, 44 and PC board 45 with conductors 46, 47 are well known in the art. Substrate 32 with its associated conductors and notches is used to form one half of a multilead connector.

Connector portion 50 (see FIGS. 3A–B) is intended to intersect with connector portion 30. Portion 50 is also conveniently a printed circuit (PC) board comprising substrate 52 of thickness 53 on whose front side "F" are located conductors 54 and on whose rear or back face "B" is located optional ground plane 56. Ground plane 56 is not essential but is highly desirable where high frequencies are involved, especially microwave frequencies.

While substrate 52 is shown as having notches 58 of widths 59 proximate to conductors 54, and this arrangement is preferred, notches 58 are not essential, as is indicated by dashed line 57. In the example shown in FIGS. 3A–B, conductors 54 connect to elements 26, but this is merely for purposes of illustration. Elements 26 are intended to represent any desired component or circuit element or combinations thereof, including but not limited active and/or passive components. Elements 26 may be signal sources or sinks or combinations thereof.

For convenience of explanation the convention is used of labelling the face of substrates 32, 52 carrying signal leads as the front "F" and the opposed rear or back face "B", carrying, for example, a ground plane. However, signal and ground conductors may be present on both faces of the substrates and various interconnections may also pass through the substrates. In microwave applications, the conductor and substrate geometry and properties (e.g., dielectric constant) are chosen so that the combination of the signal conductor, the substrate and the opposed ground plane act as a microwave conductor with a predetermined characteristic impedance. Means and methods for producing such conductor bearing substrates are well known in the art.

Connector portions or boards 30, 50 are intended to intersect, that is, slot 421 adjacent region "F1" of board 30 is intended to engage portion (e.g., notch) 581 adjacent region "F1'" of board 50. Connector portions or boards 30, 50 desirably intersect at approximately right angles although that is not essential. It is important that they not be parallel since the desired approximate L-oriented relationship of the conductors is not then obtained in the intersection region.

Figure 7A:
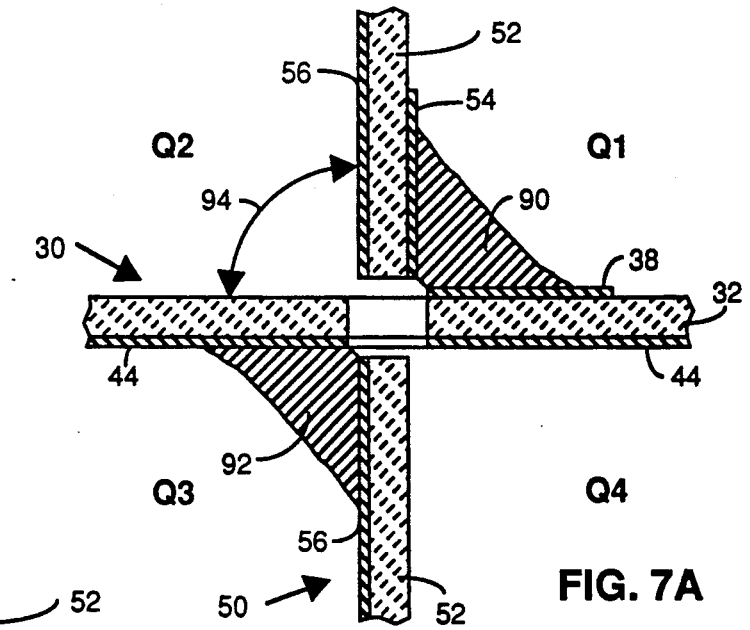
FIGS. 7A–C show partial cross-sectional views, much simplified and somewhat enlarged, of the arrangement of portions of the elements depicted in FIGS. 2A–3B at the locations indicated thereon, when such elements are engaged, and according to several embodiments of the present invention.
Figure 7B:
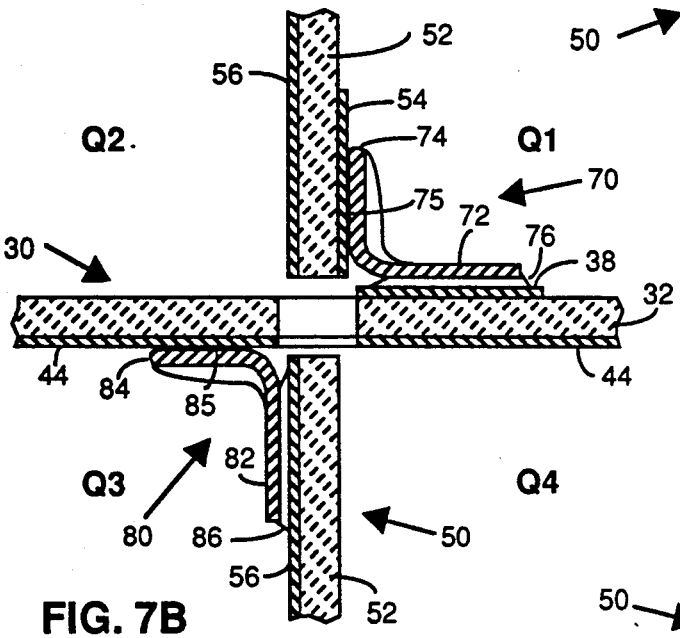
Figure 7C:
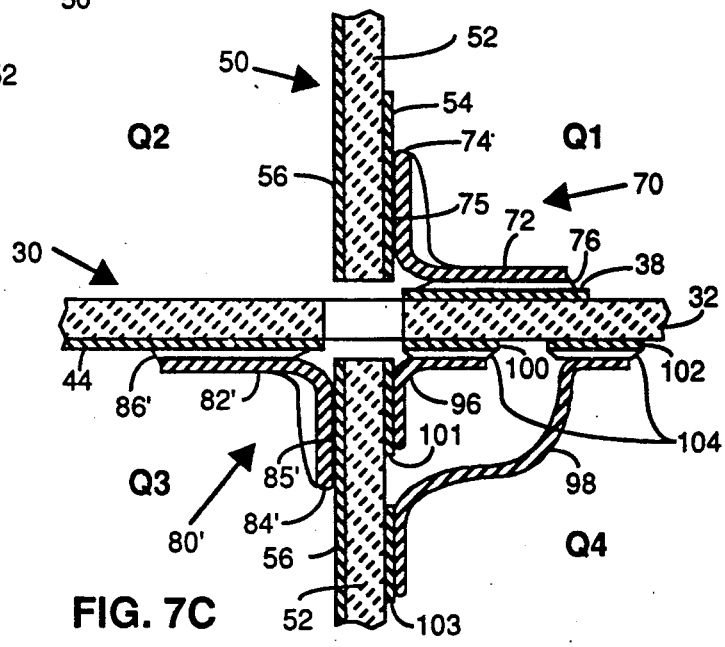

When boards 30, 50 are engaged, conductors 38 and 54 lie next to each other in an approximate L-oriented relationship, one conductor forming the upright leg of the L and the other conductor forming the flat base of the L. This is illustrated in FIGS. 7A–C which show cross-sections through the intersection region when portion 421 of board 30 is engaged by portion 581 of board 50. FIGS. 7A–C are discussed more fully later.

Figure 4:
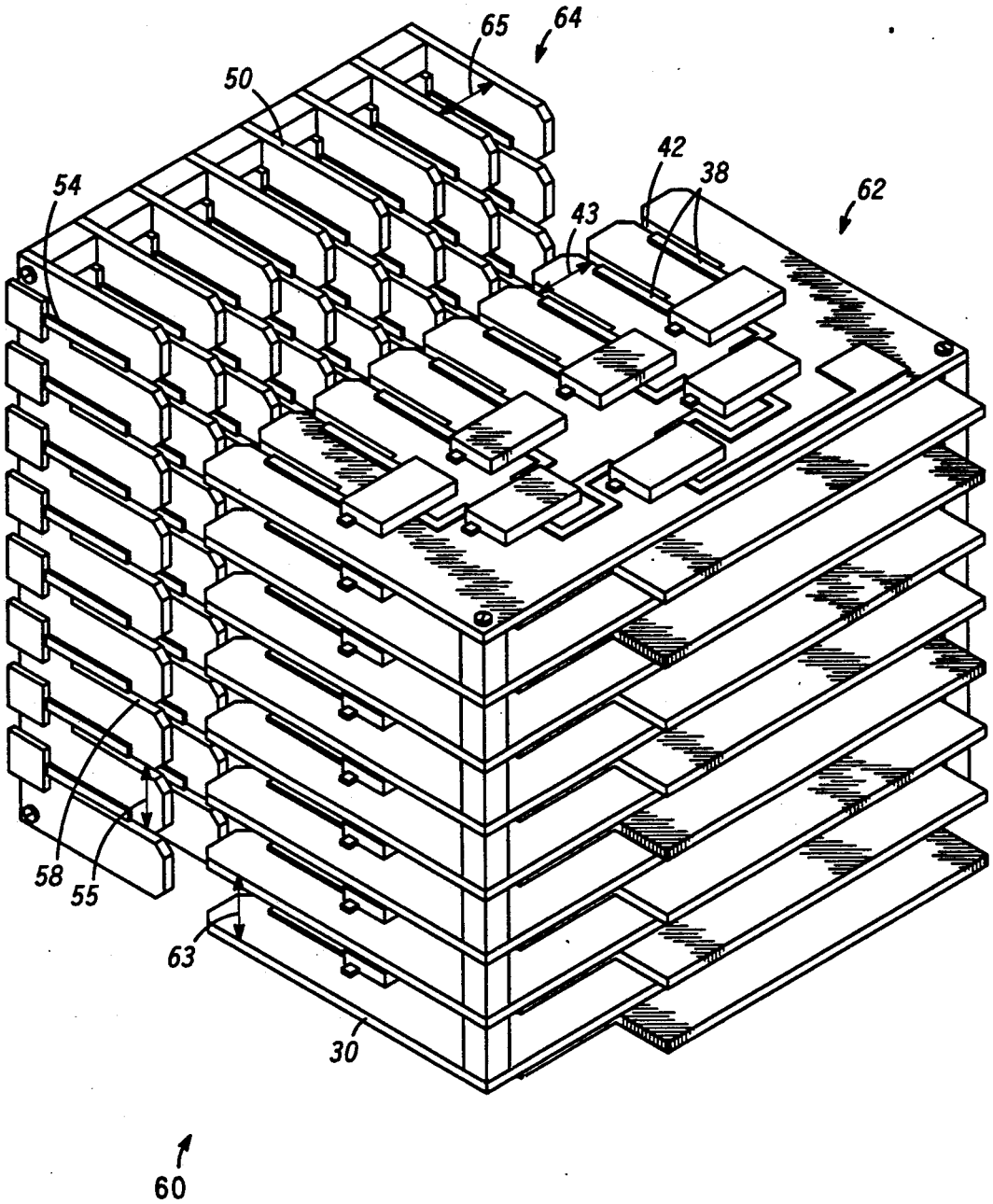
FIG. 4 shows a perspective view of a multilead connector formed from elements such as those shown in FIGS. 2A–B and 3A–B, just prior to being joined, according to a further embodiment of the present invention.

The preferred arrangement for a multilead connector is illustrated in FIG. 4 where N×M connector array 60 is shown. Multilead connector 60 comprises first assembly 62 having multiple, spaced-apart, connector portions or boards 30 with separations 63, and second assembly 64 comprising multiple, spaced-apart, portions or boards 50 with separations 65. Conductors 38, 54 face in the same direction in each assembly 62, 64, respectively. The spaced-apart connector portions or boards 30, 50 are desirably parallel. The separations between boards 30 and boards 50 need not be uniform, but need to correspond to the spacing of the conductors and/or notches of the boards with which they are intended to intersect. The spring contacts shown in FIGS. 5A–6B, 7B–C, 8 and 9 for providing separable sliding connections between conductors 38 and 54 have been omitted from FIG. 4 for simplicity and so as not to obscure the slots where the boards intersect.

For example, substrate-to-substrate spacings 63 of assembly 62 correspond to notch-to-notch or conductor-to-conductor separations 55 on substrates 50 of assembly 64, and substrate-to-substrate spacings 65 of assembly 64 corresponds to notch-to-notch or conductor-to-conductor separations 43 on substrates 30 of assembly 62. The notch-to notch and/or conductor-to-conductor spacings 43, 55 within either of boards 30, 50 may be varied, provided that the substrate-to-substrate spacing of the mating assembly is adjusted to match. Thus, the separations and spacings need not be uniform, although that is convenient.

Figure 5B:
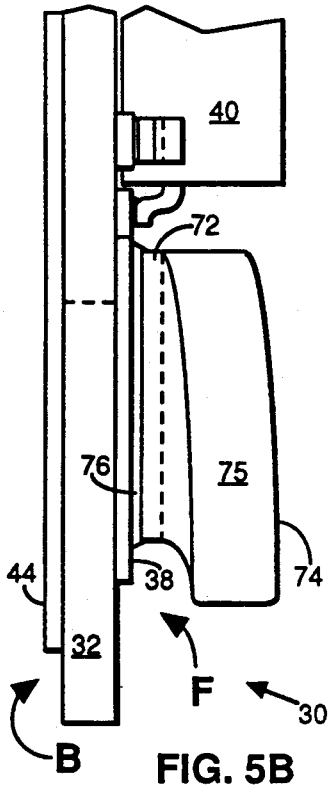
FIG. 5B shows a left side view of FIG. 5A, according to a still further embodiment of the present invention.
Figure 5A:
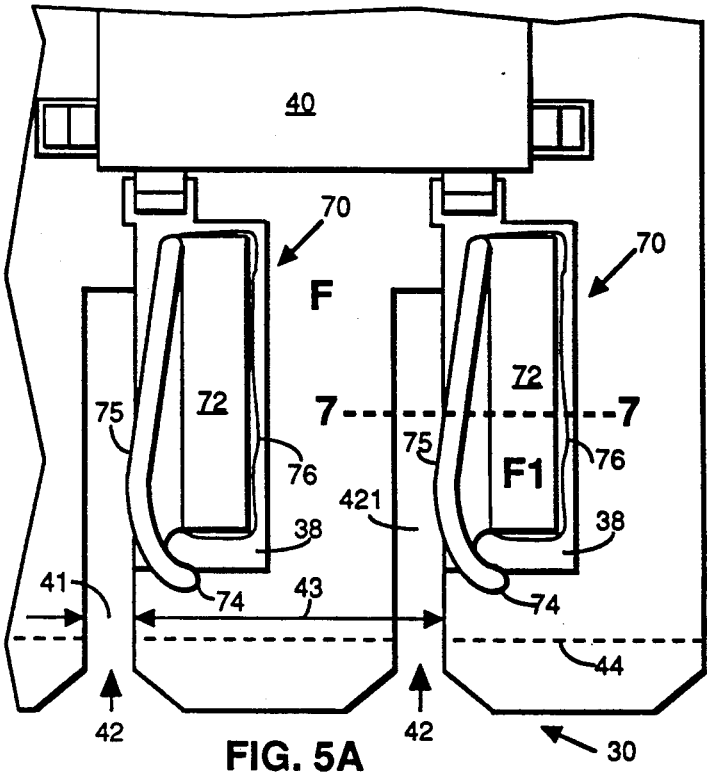
FIG. 5A shows a front view somewhat enlarged of a portion of the element of FIGS. 2A–B.
Figure 6A:
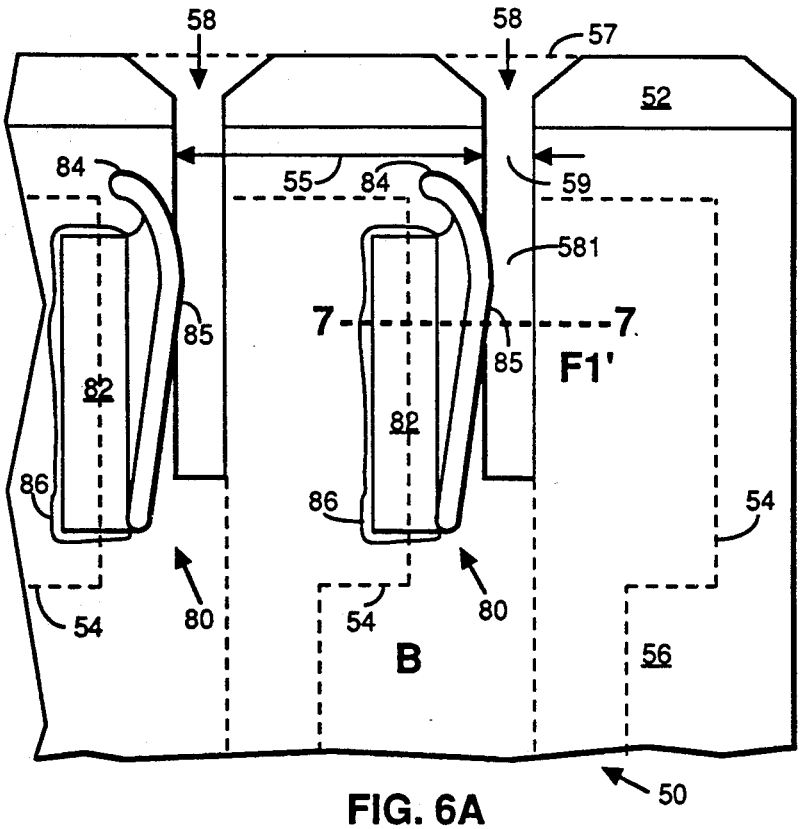
FIG. 6A shows a rear view somewhat enlarged of a portion of the element of FIGS. 3A–B.
Figure 6B:
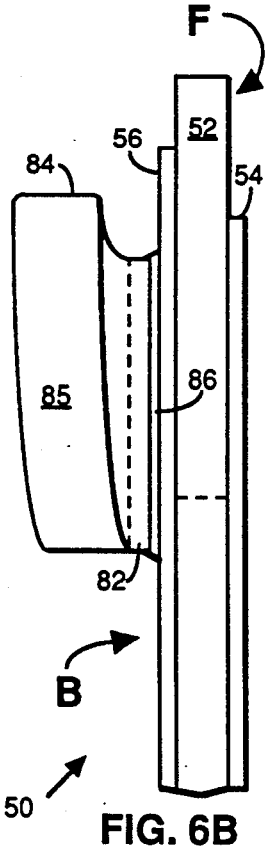
FIG. 6B shows a right side view of FIG. 5A, according to a still further embodiment of the present invention.

FIG. 5A shows an enlarged front view of portion Fl of board 30 of FIG. 2A and FIG. 5B shows a left side view of FIG. 5A, and FIG. 6A shows an enlarged rear (back) view of portion F1' of board 50 and FIG. 6B shows a right side view of FIG. 6A. Slots 421 and 581 are intended to intersect. These figures illustrate further embodiments of the invention.

Referring now to FIGS. 5A–B, conductors 38 have thereon one or more spring contacts 70 comprising flat bases 72 and upright portions 74. Bases 72 are attached, e.g., by solders 76, to conductors 38. Faces 75 of upright portions 74 of springy contacts 70 makes sliding engagement to conductors 54 of board 50 when inserted in slots 42. Thus, positive electrical connection between conductors 38 and 54 is assured.

Referring now to FIGS. 6A–B, back-side or ground plane conductor 56 has thereon one or more spring contacts 80 comprising flat bases 82 and upright portions 84. Bases 82 are attached, e.g., by solders 86, to conductor 56. Faces 85 of upright portions 84 of springy contacts 80 makes sliding engagement to back-side or ground plane conductor 44 of board 30 when inserted in slots 42. Thus, positive electrical connection between conductors 56 and 44 is assured.

While conductors 44 and 56 are shown as being continuous ground planes, this is merely for convenience of explanation. Those of skill in the art will understand based on the description herein that conductors 44, 56 can comprise a multiplicity of individual conductors some acting as reference (e.g., ground) leads and others acting as signal leads. Further, while FIGS. 5A–6B show particular arrangements for flexible contacts 70, 80, other contact arrangements will also serve provided that they bridge between L-oriented conductor pairs 38, 54 and/or between L-oriented conductor pairs 44, 56 so as to make the desired connections.

FIGS. 7A–C show partial cross-sectional views, much simplified and somewhat enlarged, of the arrangement of regions F1, F1' of the elements depicted in FIGS. 2A-3B and 5A-6B, when such regions are engaged, and according to several embodiments of the present invention. The engaged boards 30, 50 define four quadrants, labelled Q1, Q2, Q3, Q4 in FIGS. 7A-C. The L-oriented relationship between conductors 38, 54 in Q1 (front-to-front orientation) and between conductors 44, 56 in Q3 (back-to-back orientation) is readily apparent. While intersection angle 94 between boards 30, 50 is shown as being approximately ninety degrees, larger or smaller angles also serve, provided that angle 94 is not zero or one-hundred and eighty degrees (i.e., boards 30, 50 parallel) since, in that situation, simultaneous front-to-front conductor connections and back-to-back conductor connections may not be readily made with planar boards.

FIG. 7A shows an arrangement in which L-oriented conductors 38, 54 are joined by solder region 90 and L-Oriented conductors 44, 56 are joined by solder region 92. This illustrates what is obtained when boards 30, 50 of FIGS. 2A-3B are engaged, e.g., slot or notch of board 50 inserted in slot or notch 42 of board 30, and solder regions 90, 92 placed in the overlap regions as shown to couple the adjacent leads. The finger region labelled F1 is then in L-oriented relationship with the finger region labelled F1'

FIG. 7B shows an arrangement in which the relative placement of boards 30, 50 is the same as in FIG. 7A but where L-oriented conductors 38, 54 are joined by spring contacts 70 and L-oriented conductors 44, 56 are joined by contacts 80. This illustrates the result when boards 30, 50 having spring contacts 70, 80 arranged as shown in FIGS. 5A-6B are engaged.

In FIGS. 5A-B and 7B, spring contact 70 is shown as being soldered to lead 38 and making sliding pressure contact to lead 54, and spring contact 80 is shown as being soldered to lead 56 and making sliding pressure contact to lead 44. However, other combinations are also useful. One of the alternatives is illustrated in FIG. 7C in which contact 70 is attached as before to lead 38 but contact 80' which is otherwise identical to contact 80 is attached to conductor 44 by solder 86' and makes sliding contact to conductor 56. In the arrangement of FIG. 7B, front-side spring contacts are attached to conductors on one board and back-side spring contacts are attached to conductors on the other board. In the arrangement of FIG. 7C, front-side and back-side contacts are both attached to conductors (e.g., 38, 44) on the same board (e.g., board 30) and make sliding contact to conductors (e.g., 54, 56) on the other board (e.g., board 50). The choice of boards to which the contacts attach may be varied and, except for convenience of construction issues which depends upon the particular desired board configuration, the spring contacts may be mounted on one board or the other or some on each board.

While FIGS. 5A-7C show spring contacts of a particular configuration, any arrangement of flexible or resilient contacts for coupling L-oriented mating conductors on adjacent surfaces of the intersecting boards may be used.

EXAMPLE

An orthogonal RF connection was evaluated using copper microstrip lines on Type 6006 and/or 6010 PC board obtained from the Rogers Co., Chandler, Ariz. This is a well known ceramic impregnated plastic circuit board with etchable copper foil conductors thereon commonly used in the microwave art to construct a wide variety of RF and microwave circuits and systems. For example, large numbers of electronic components of many different types are mounted on such boards and interconnected using conductor paths formed by etching the copper surface foil into the desired configuration to provide the desired circuit or system function.

For the test pieces, the copper foil on one side of two pieces of PC board was etched to form microwave conductors having a nominal fifty Ohms impedance. The configuration of the test pieces is shown approximately in FIGS. 8-9. The primed reference numbers used on FIGS. 8-9 refer to regions analogous to those identified by the same but un-primed numbers in the FIGS. 5A-7C.

Figure 8:
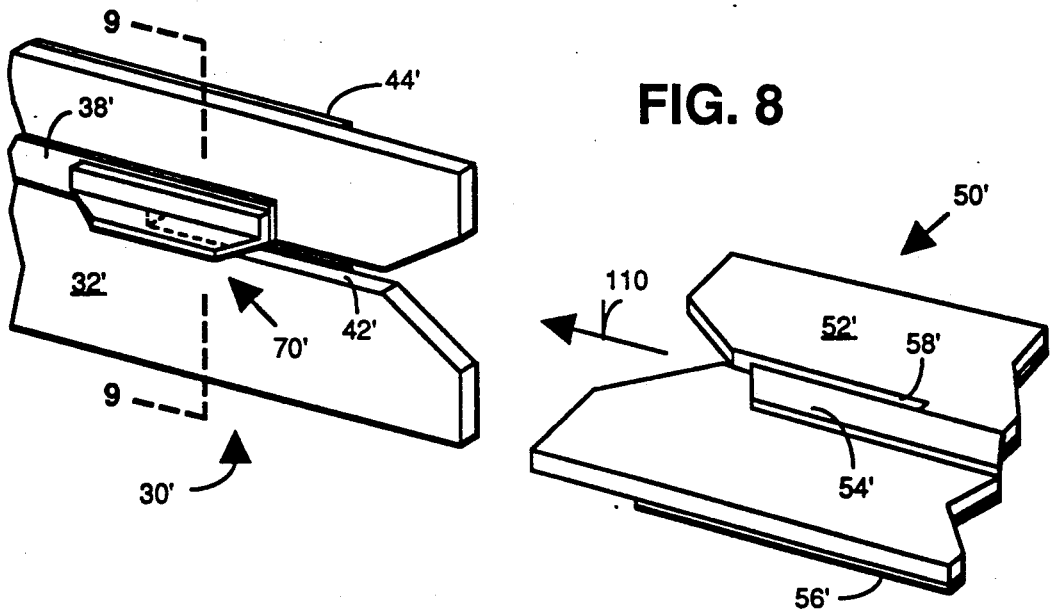
FIG. 8 shows a simplified perspective view of one lead of the connector as the separable portions are about to be engaged, according to a further embodiment of the present invention.
Figure 9:
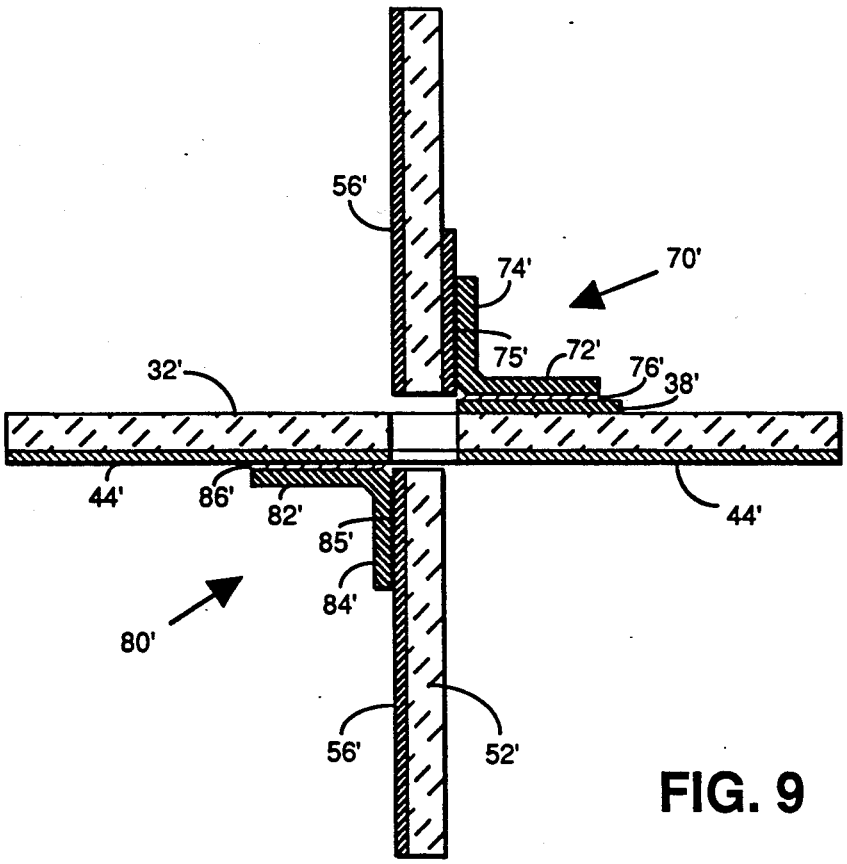
FIG. 9 shows a simplified cross-sectional view through a portion of the structure of FIG. 8 at the location indicated thereon.

FIG. 8 shows a perspective view of test pieces 30', 50' about to be engaged in the direction of arrow 110 and FIG. 9 shows a simplified cross-sectional view through the portion of the test pieces when engaged, at the location indicated in FIG. 8 and with simple "L" shaped spring contact 70' attached thereto.

Test pieces 30', 50' comprise substrate portions 32', 52' having slots 42', 58' cut into their ends and of a width slightly greater than the board thickness so that test pieces 30', 50' were easily slipped together in about a right-angle configuration by engaging slots 42', 58'. Copper foil conductors 38', 54' extend alongside slots 42', 58', approximately as shown FIGS. 8-9. Ground planes foils 44' and 56' were provided on the back faces of test pieces 30', 50' as previously described. When portions 30', 50' were engaged as shown by arrow 110, conductors 38', 54' in the overlap region had the configuration about that shown in FIGS. 7A-B and FIG. 9.

The opposed back-side foil on the PC board test pieces formed ground planes 44', 56' underneath conductors 38', 54' and around slots or notches 42', 58', substantially as shown in the figures. For simplicity, only one signal conductor and slot was provided on each test piece 30', 50'. Standard microwave coaxial connectors were soldered to the ends or sides of the of the test pieces opposite the slots so that signals could be applied to the demountable joint represented by the overlapping L-oriented intersection region of the two PC boards to evaluate the electrical properties of the slotted connector configuration.

The slotted test pieces 30', 50' shown in FIG. 8 but without "L"-shaped contact 70' were engaged and the overlap regions soldered together, to give approximately the configuration illustrated in FIG. 7A. The electrical properties were then measured and used as the baseline control.

Tests were performed over a frequency range from about 0.045 gigaHertz (GHz) to about 1.0 GHz. With the base-line soldered connections, the insertion loss varied from about 0.02 db at 0.045 GHz to about 0.22 db at about 0.5 GHz to about 0.2 db at 1.0 GHz. At 0.045 GHz the reflection loss was about 33 db, at about 0.5 GHz about 14 db and at about 1.0 GHz about 17 db.

The solder was removed and the slotted test pieces 30', 50' disengaged. Spring contacts 70', 80' as shown in FIGS. 8-9 were then soldered on the same test pieces in the intersection overlap region. Spring contacts 70', 80' have base portions 72', 82' attached to conductors 38', 44' by solders 76', 86' and up-right portions 74', 84' with faces 75', 85' which bear against conductors 54', 56' of substrates 52' when the test pieces are re-engaged.

The test pieces were re-engaged so that coupling between the conductors on the L-oriented PC boards 30', 50' was now provided by slip-joint spring contact 70'. The electrical measurements were then repeated under otherwise substantially identical conditions.

Very little difference in electrical behavior was observed between the solder connections and the slip-joint spring finger connections, i.e., the maximum insertion loss and the reflection loss of the slip-joint connections were approximately the same as with the soldered connections, the change being less than ten percent. This indicates that the use of the spring contacts to provide for easy engagement and disengagement of the connector does not substantially degrade performance.

It was further determined that the overall performance of the connector arrangement could be improved by providing tuning stubs adjacent signal leads 38', 54', and adjusting these to tune out various electrical anomalies associated with the microwave conductors on the PC board pieces serving as test connectable boards 30', 50'. Such tuning stubs are small metal regions generally oriented orthogonal to conductors 38', 54' to add additional capacitance or inductance or a combination thereof to tune the associated microwave conductor. Construction and adjustment of tuning stubs for such purposes are well known in the art. The tuning stubs decreased the insertion loss by 10–50 percent depending upon the frequency. The overall magnitude of the reflection loss was about the same but the frequency dependence changed, reflecting the frequency dependence of the tuning stubs.

Based on the foregoing description, it will be apparent to those of skill in the art that the present invention solves the problems and achieves the results set forth earlier, and has substantial advantages as pointed out herein, namely, the present invention provides an improved means and method for electrical connectors. While the present invention functions well at DC as well as low to intermediate frequencies, it is especially useful for multilead connectors intended for microwave frequencies.

The present invention is especially convenient in connection with circuit boards and the like employing planar conductors and can accommodate a very large number of leads in a comparatively small space. Further, the circuit boards forming the demountable connector may include electronic components forming a desired circuit function without any need for a further connector thereto, i.e., provide an integral connector and circuit function. Examples of components or elements that may be included on the same substrate or substrates which form the connector, e.g., as a part of board 30, 50, are amplifiers, switches, baluns, power dividers, phase shifters, modulators, transformers, capacitors, resistors, inductors, radiators and various other well known electronic or electrical components. In addition, connectors of many different lead counts and geometries may be easily fabricated without having to resort to special tooling as has been necessary in the past with prior art multilead and multicoaxial connectors.

A further feature of the present invention especially useful at microwave frequencies is that the ground planes necessary to preserve substantial impedance uniformity and provide shielding of multiple signals extend continuously through the connector. That is, the ground planes engage and are connected at the same time and in the same way as the signal connections so that there is no part of the signal lead that must depart from its predetermined relationship to its companion ground plane (or other conductors) as the connection between the parts of the connector is made or broken.

In addition, while the connector has been illustrated for the situation where one signal lead and one ground plane on each connector half (e.g., on boards 30, 50) are coupled at each L-oriented intersection (e.g, in Q1 and Q3), other connections may also be simultaneously made in the same or other quadrants. For example, conductors in L-oriented arrangement in quadrants Q2, Q4 may also be coupled in much the same way as discussed for the connections in Q1, Q3.

Further, by using multiple spring contacts in any quadrant, more than one connection per quadrant is obtained. This is illustrated by connections 96, 98 in Q4 of FIG. 7C coupling conductors 100, 101 and 102, 103, respectively. Connection 96 is conveniently substantially similar to connection 80, e.g., soldered to one of conductors 100, 101 (e.g., by solder 104) and making sliding contact to the other, but of somewhat smaller size. Connection 98 is also similar but having a longer spring arm so as to bridge the larger distance from conductor 102 to 103. As with contact 96 it may be attached to either conductor 102, 103 (e.g., by solder 104) and make sliding contact to the other. Both contacts desirably provide slip joint action.

In addition, the invented connector is much less complex in design and construction compared to prior art connectors able to function at microwave frequencies, as for example, multilead coaxial connectors, and thus provides further advantages of manufacturing simplicity and lower cost.

While the present invention has been described in terms of particular materials, structures and steps, these choices are for convenience of explanation and not intended to be limiting and, as those of skill in the art will understand based on the description herein, the present invention applies to other choices of materials, arrangements and process steps, and it is intended to include in the claims that follow, these and other variations as will occur to those of skill in the art based on the present disclosure.

We claim:

1. An electrical connector comprising;

at least first and second insulating substrates adapted to intersect so that at least one principal face of the first substrate is not parallel with at least one principal face of the second substrate;

electrical leads located on the at least one principal face of each substrate which make contact when the substrates intersect; and wherein the substrates have signal leads on front faces thereof and ground planes on opposed back faces thereof and the intersection of the substrates provides four quadrants therebetween, designated sequentially as quadrants one through four, and wherein signal leads on the substrates are coupled in the first quadrant and ground planes on the substrates are coupled in the third quadrant.

2. An electrical connector comprising:

at least first and second insulating substrates adapted to intersect so that at least one principal face of the first substrate is not parallel with at least one principal face of the second substrate;

electrical leads located on the at lest one principal face of each substrate which make contact when the substrates intersect; and wherein the substrates have signal leads on front faces thereof and ground planes on opposed back faces thereof and the intersection of the substrates provides four quadrants therebetween, designated sequentially as quadrants one through four, and wherein signal leads on the substrates are coupled in the first quadrant and ground planes on the substrates are coupled in the third quadrant, and wherein one or more leads in the second or fourth quadrants are coupled.

3. The connector of claim 1 wherein at least one substrate further comprises elements for amplifying or switching a signal directed to one or more electrical leads coupled form the first to the second substrate.

4. The connector of claim 1 wherein the first substrate has a first thickness extending between opposed principal faces and at least one electrical lead extending toward an edge thereof, and wherein the second substrate has opposed principal faces and one or more notches extending between the principal faces inwardly form an edge of the second substrate and of a width to receive the first thickness and at least one electrical lead extending toward the edge and proximate to the one or more notches, so that when the substrates interpenetrate, an electrical lead of the first substrate and an electrical lead of the second substrate are adjacent.

5. The connector of claim 1 further comprising one or more flexible contact means for providing positive contact between electrical leads located on adjacent principal faces of each substrate where the substrates interpenetrate.

6. The connector of claim 5 further comprising resilient conductor means located where the substrates interpenetrate for coupling a ground plane on the first substrate to a ground plane of the second substrate.

7. An electrical connector comprising:

at least first and second insulating substrates adapted to interpenetrate so that at least one principal face of the first substrate is not parallel with at least one principal face of the second substrate; and electrical leads located on the at least one principal face of each substrate which electrically couple by springy electrical contacts which deflect substantially in a direction perpendicular to a broad face of the springy electrical contact when the substrates interpenetrate;

wherein the first substrate has a first thickness extending between opposed principal faces and at least one electrical lead extending toward an edge thereof, and wherein the second substrate has opposed principal faces and one or more notches extending between the principal faces inwardly from an edge of the second substrate and of a width to receive the first thickness and at least one electrical lead extending toward the edge and proximate to the one or more notches, so that when the substrates interpenetrate, an electrical lead of the first substrate and an electrical lead of the second substrate are adjacent; and wherein the second substrate has a second thickness extending between the opposed principal faces, and wherein the first substrate has one or more notches extending between the opposed principal faces inwardly from an edge of the first substrate and of a width to receive the second thickness and wherein the electrical lead of the first substrate extends proximate to the one or more notches, so that when the substrates interpenetrate with a notch of one engaging a notch of the other, the electrical lead of the first substrate and the electrical lead of the second substrate are adjacent.

8. The connector of claim 7 further comprising ground planes on principal faces opposed to principal faces containing the electrical leads, and wherein the ground planes of each substrate are proximate along sides of the notches when the substrates interpenetrate.

9. A multilead microwave connector comprising:

a first assembly of PC boards spaced apart by first distances and each having on first faces thereof, multiple first planar conductors oriented toward an edge thereof and having ground planes on opposed second faces thereof, and wherein the PC boards are spaced apart by second distances;

a second assembly of PC boards spaced apart by third distances and each having on first faces thereof, multiple second planar conductors oriented toward an edge thereof and having ground planes on opposed second faces thereof, and wherein the PC boards are spaced apart by fourth distances;

wherein the first distances substantially equal the fourth distances and the second distances substantially equal the third distances;

wherein the first and second assemblies engage so that the multiple first and second planar conductors are adjacent in approximately right angle relationship and coupled by slip contacts which deflect on engagement in a direction substantially perpendicular to a broad face of the slip contact and press only on single faces of the planar conductors; and wherein the engaged assemblies form intersections of the PC boards providing four quadrants therebetween, designated sequentially as quadrants one through four, and wherein the multiple first and second planar conductors are coupled in the first quadrant and the ground planes are coupled in the third quadrant.

* * * * *

UNITED STATES PATENT AND TRADEMARK OFFICE

CERTIFICATE OF CORRECTION

PATENT NO. : 5,190,462

DATED : March 2, 1993

INVENTOR(S) : John K. Lauchner et al

It is certified that error appears in the above-identified patent and that said Letters Patent is hereby corrected as shown below:

Col. 10, line 66, claim 2, change "lest" to --least--.

Col. 11, line 21, claim 4, change "form" to --from--.

Signed and Sealed this

Eleventh Day of January, 1994

Bruce Lehman

*Attest:*

BRUCE LEHMAN

*Attesting Officer*

*Commissioner of Patents and Trademarks*